US008640975B2

(12) United States Patent
King

(10) Patent No.: US 8,640,975 B2
(45) Date of Patent: Feb. 4, 2014

(54) MINIATURE AEROSOL JET AND AEROSOL JET ARRAY

(75) Inventor: Bruce H. King, Albuquerque, NM (US)

(73) Assignee: Optomec, Inc., Albuquerque, NM (US)

( * ) Notice: Subject to any disclaimer, the term of this patent is extended or adjusted under 35 U.S.C. 154(b) by 183 days.

(21) Appl. No.: 12/687,424

(22) Filed: Jan. 14, 2010

(65) Prior Publication Data

US 2010/0173088 A1 Jul. 8, 2010

Related U.S. Application Data

(63) Continuation of application No. 11/302,091, filed on Dec. 12, 2005, now Pat. No. 7,938,341.

(60) Provisional application No. 60/635,847, filed on Dec. 13, 2004, provisional application No. 60/669,748, filed on Apr. 8, 2005.

(51) Int. Cl.
*F23D 11/16* (2006.01)

(52) U.S. Cl.
USPC ..... 239/419; 239/419.3

(58) Field of Classification Search
USPC ..... 239/398, 416.4, 416.5, 417.5, 423, 290, 239/291, 294, 419, 419.3
See application file for complete search history.

(56) References Cited

U.S. PATENT DOCUMENTS

| | | | |
|---|---|---|---|
| 3,474,971 | A | 10/1969 | Goodrich |
| 3,590,477 | A | 7/1971 | Cheroff et al. |
| 3,642,202 | A | 2/1972 | Angelo |
| 3,715,785 | A | 2/1973 | Brown et al. |
| 3,808,432 | A | 4/1974 | Ashkin |
| 3,808,550 | A | 4/1974 | Ashkin |
| 3,846,661 | A | 11/1974 | Brown et al. |
| 3,854,321 | A | 12/1974 | Dahneke |
| 3,901,798 | A | 8/1975 | Peterson |
| 3,959,798 | A | 5/1976 | Hochberg et al. |

(Continued)

FOREIGN PATENT DOCUMENTS

| | | |
|---|---|---|
| DE | 198 41 401 | 4/2000 |
| EP | 0 331 022 A2 | 9/1989 |

(Continued)

OTHER PUBLICATIONS

*Webster's Ninth New Collegiate Dictionary* Merriam-Webster, Inc., Springifled, MA. USA 1990 , 744.

(Continued)

*Primary Examiner* — Davis Hwu
(74) *Attorney, Agent, or Firm* — Philip D. Askenazy; Peacock Myers, P.C.

(57) ABSTRACT

A miniaturized aerosol jet, or an array of miniaturized aerosol jets for direct printing of various aerosolized materials. In the most commonly used embodiment, an aerosol stream is focused and deposited onto a planar or non-planar target, forming a pattern that is thermally or photochemically processed to achieve physical, optical, and/or electrical properties near that of the corresponding bulk material. The apparatus uses an aerosol jet deposition head to form an annularly propagating jet composed of an outer sheath flow and an inner aerosol-laden carrier flow. Miniaturization of the deposition head facilitates the fabrication and operation of arrayed deposition heads, enabling construction and operation of arrays of aerosol jets capable of independent motion and deposition. Arrayed aerosol jets provide an increased deposition rate, arrayed deposition, and multi-material deposition.

11 Claims, 13 Drawing Sheets

(56) References Cited

Figure 1A:
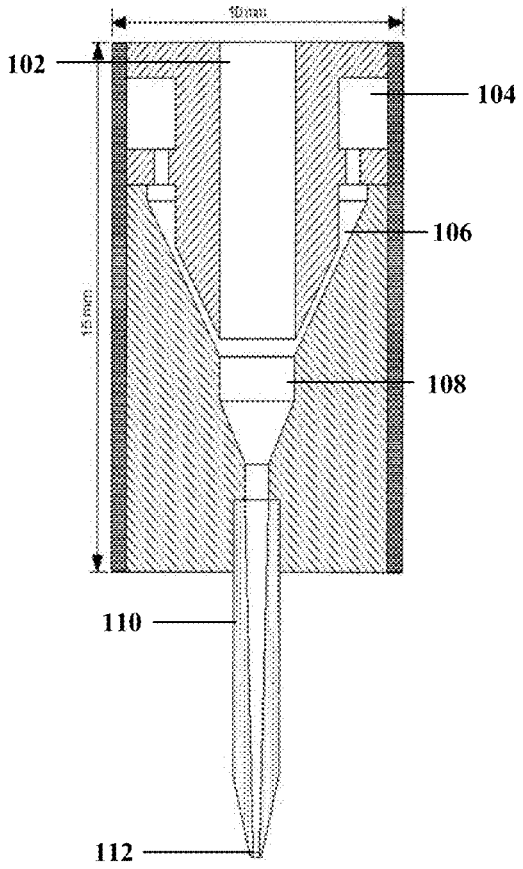

U.S. PATENT DOCUMENTS 3,974,769 A 8/1976 Hochberg et al.
3,982,251 A 9/1976 Hochberg
4,004,733 A 1/1977 Law
4,016,417 A 4/1977 Benton
4,019,188 A 4/1977 Hochberg
4,034,025 A 7/1977 Martner
4,036,434 A 7/1977 Anderson et al.
4,046,073 A 9/1977 Mitchell et al.
4,046,074 A 9/1977 Hochberg et al.
4,092,535 A 5/1978 Ashkin et al.
4,112,437 A 9/1978 Mir et al.
4,132,894 A 1/1979 Yule
4,171,096 A 10/1979 Welsh et al.
4,200,669 A 4/1980 Schaefer et al.
4,228,440 A 10/1980 Horike et al.
4,269,868 A 5/1981 Livsey
4,323,756 A 4/1982 Brown et al.
4,453,803 A 6/1984 Hidaka et al.
4,485,387 A 11/1984 Drumheller
4,497,692 A 2/1985 Gelchinski et al.
4,601,921 A 7/1986 Lee
4,605,574 A 8/1986 Yonehara et al.
4,670,135 A 6/1987 Marple et al.
4,685,563 A 8/1987 Cohen et al.
4,689,052 A 8/1987 Ogren et al.
4,694,136 A 9/1987 Kasner et al.
4,823,009 A 4/1989 Biemann et al.
4,825,299 A 4/1989 Okada et al.
4,826,583 A 5/1989 Biernaux et al.
4,893,886 A 1/1990 Ashkin et al.
4,904,621 A 2/1990 Loewenstein et al.
4,911,365 A 3/1990 Thiel et al.
4,920,254 A 4/1990 DeCamp et al.
4,947,463 A 8/1990 Matsuda et al.
4,971,251 A * 11/1990 Dobrick et al. ..... 239/346
4,997,809 A 3/1991 Gupta
5,032,850 A 7/1991 Andeen et al.
5,043,548 A 8/1991 Whitney et al.
5,064,685 A 11/1991 Kestenbaum et al.
5,164,535 A 11/1992 Leasure
5,170,890 A 12/1992 Wilson et al.
5,176,744 A 1/1993 Muller
5,182,430 A 1/1993 Lagain
5,194,297 A 3/1993 Scheer et al.
5,208,431 A 5/1993 Uchiyama et al.
5,245,404 A 9/1993 Jannson et al.
5,250,383 A 10/1993 Naruse
5,254,832 A 10/1993 Gartner et al.
5,270,542 A 12/1993 McMurry et al.
5,292,418 A 3/1994 Morita et al.
5,322,221 A 6/1994 Anderson
5,335,000 A 8/1994 Stevens
5,344,676 A 9/1994 Kim et al.
5,359,172 A 10/1994 Kozak et al.
5,366,559 A 11/1994 Periasamy
5,378,505 A 1/1995 Kubota et al.
5,378,508 A 1/1995 Castro et al.
5,403,617 A 4/1995 Haaland
5,425,802 A 6/1995 Burton et al.
5,449,536 A 9/1995 Funkhouser
5,486,676 A 1/1996 Aleshin
5,491,317 A 2/1996 Pirl
5,495,105 A 2/1996 Nishimura et al.
5,512,745 A 4/1996 Finer et al.
5,607,730 A 3/1997 Ranalli
5,609,921 A 3/1997 Gitzhofer et al.
5,612,099 A 3/1997 Thaler
5,614,252 A 3/1997 McMillan et al.
5,648,127 A 7/1997 Turchan et al.
5,676,719 A 10/1997 Stavropoulos et al.
5,732,885 A * 3/1998 Huffman ..... 239/416.5
5,733,609 A 3/1998 Wang
5,736,195 A 4/1998 Haaland
5,742,050 A 4/1998 Amirav et al.
5,770,272 A 6/1998 Biemann et al.
5,772,106 A 6/1998 Ayers et al.
5,772,964 A 6/1998 Prevost et al.
5,814,152 A 9/1998 Thaler
5,844,192 A 12/1998 Wright et al.
5,854,311 A 12/1998 Richart
5,861,136 A 1/1999 Glicksman et al.
5,882,722 A 3/1999 Kydd
5,894,403 A 4/1999 Shah et al.
5,940,099 A 8/1999 Karlinski
5,958,268 A 9/1999 Engelsberg et al.
5,965,212 A 10/1999 Dobson et al.
5,980,998 A 11/1999 Sharma et al.
5,993,549 A 11/1999 Kindler et al.
5,993,554 A 11/1999 Keicher et al.
5,997,956 A 12/1999 Hunt et al.
6,007,631 A 12/1999 Prentice et al.
6,015,083 A 1/2000 Hayes et al.
6,025,037 A 2/2000 Wadman et al.
6,036,889 A 3/2000 Kydd
6,110,144 A 8/2000 Choh et al.
6,116,718 A 9/2000 Peeters et al.
6,136,442 A 10/2000 Wong
6,151,435 A 11/2000 Pilloff
6,159,749 A 12/2000 Liu
6,182,688 B1 2/2001 Fabre
6,197,366 B1 3/2001 Takamatsu
6,251,488 B1 6/2001 Miller et al.
6,258,733 B1 7/2001 Solayappan et al.
6,265,050 B1 7/2001 Wong et al.
6,267,301 B1 * 7/2001 Haruch ..... 239/290
6,290,342 B1 9/2001 Vo et al.
6,291,088 B1 9/2001 Wong
6,293,659 B1 9/2001 Floyd et al.
6,328,026 B1 12/2001 Wang et al.
6,340,216 B1 1/2002 Peeters et al.
6,348,687 B1 2/2002 Brockmann et al.
6,349,668 B1 2/2002 Sun et al.
6,379,745 B1 4/2002 Kydd et al.
6,384,365 B1 5/2002 Seth et al.
6,390,115 B1 5/2002 Rohwer et al.
6,391,494 B2 5/2002 Reitz et al.
6,406,137 B1 6/2002 Okazaki et al.
6,416,156 B1 7/2002 Noolandi et al.
6,416,157 B1 7/2002 Peeters et al.
6,416,158 B1 7/2002 Floyd et al.
6,416,159 B1 7/2002 Floyd et al.
6,416,389 B1 7/2002 Perry et al.
6,454,384 B1 9/2002 Peeters et al.
6,467,862 B1 10/2002 Peeters et al.
6,471,327 B2 10/2002 Jagannathan et al.
6,481,074 B1 11/2002 Karlinski
6,486,432 B1 11/2002 Colby et al.
6,503,831 B2 1/2003 Speakman
6,513,736 B1 2/2003 Skeath et al.
6,521,297 B2 2/2003 McDougall et al.
6,537,501 B1 3/2003 Holl et al.
6,544,599 B1 4/2003 Brown et al.
6,548,122 B1 4/2003 Sharma et al.
6,564,038 B1 5/2003 Bethea et al.
6,573,491 B1 6/2003 Marchitto et al.
6,607,597 B2 8/2003 Sun et al.
6,636,676 B1 10/2003 Renn
6,646,253 B1 11/2003 Rohwer et al.
6,656,409 B1 12/2003 Keicher et al.
6,772,649 B2 8/2004 Zimmermann et al.
6,774,338 B2 8/2004 Baker et al.
6,780,377 B2 8/2004 Hall et al.
6,811,805 B2 11/2004 Gilliard et al.
6,823,124 B1 11/2004 Renn et al.
6,890,624 B1 5/2005 Kambe et al.
6,921,626 B2 7/2005 Ray et al.
6,998,785 B1 2/2006 Silfvast et al.
7,009,137 B2 3/2006 Guo et al.
7,045,015 B2 5/2006 Renn et al.
7,108,894 B2 9/2006 Renn
7,270,844 B2 9/2007 Renn
7,294,366 B2 11/2007 Renn et al.
7,485,345 B2 2/2009 Renn et al.
7,658,163 B2 2/2010 Renn et al.

(56) References Cited

U.S. PATENT DOCUMENTS

| | | | |
|---|---|---|---|
| 7,674,671 | B2 | 3/2010 | Renn et al. |
| 2001/0046551 | A1 | 11/2001 | Falck et al. |
| 2002/0012743 | A1 | 1/2002 | Sampath et al. |
| 2002/0071934 | A1 | 6/2002 | Marutsuka |
| 2002/0096647 | A1 | 7/2002 | Moors et al. |
| 2002/0100416 | A1 | 8/2002 | Sun et al. |
| 2002/0132051 | A1 | 9/2002 | Choy |
| 2002/0162974 | A1 | 11/2002 | Orsini et al. |
| 2003/0003241 | A1 | 1/2003 | Suzuki et al. |
| 2003/0020768 | A1 | 1/2003 | Renn |
| 2003/0048314 | A1 | 3/2003 | Renn |
| 2003/0108511 | A1 | 6/2003 | Sawhney |
| 2003/0108664 | A1 | 6/2003 | Kodas et al. |
| 2003/0117691 | A1 | 6/2003 | Bi et al. |
| 2003/0138967 | A1 | 7/2003 | Hall et al. |
| 2003/0175411 | A1 | 9/2003 | Kodas et al. |
| 2003/0180451 | A1 | 9/2003 | Kodas et al. |
| 2003/0202043 | A1 | 10/2003 | Moffat et al. |
| 2003/0219923 | A1 | 11/2003 | Nathan et al. |
| 2003/0228124 | A1 | 12/2003 | Renn et al. |
| 2004/0004209 | A1 | 1/2004 | Matsuba et al. |
| 2004/0029706 | A1 | 2/2004 | Barrera et al. |
| 2004/0038808 | A1 | 2/2004 | Hampden-Smith et al. |
| 2004/0080917 | A1 | 4/2004 | Steddom et al. |
| 2004/0151978 | A1 | 8/2004 | Huang |
| 2004/0179808 | A1 | 9/2004 | Renn |
| 2004/0185388 | A1 | 9/2004 | Hirai |
| 2004/0191695 | A1 | 9/2004 | Ray et al. |
| 2004/0197493 | A1 | 10/2004 | Renn et al. |
| 2004/0247782 | A1 | 12/2004 | Hampden-Smith et al. |
| 2005/0002818 | A1 | 1/2005 | Ichikawa |
| 2005/0110064 | A1 | 5/2005 | Duan et al. |
| 2005/0129383 | A1 | 6/2005 | Renn et al. |
| 2005/0133527 | A1 | 6/2005 | Dullea et al. |
| 2005/0145968 | A1 | 7/2005 | Goela et al. |
| 2005/0147749 | A1 | 7/2005 | Liu et al. |
| 2005/0156991 | A1 | 7/2005 | Renn |
| 2005/0163917 | A1 | 7/2005 | Renn |
| 2005/0184328 | A1 | 8/2005 | Uchiyama et al. |
| 2005/0205415 | A1 | 9/2005 | Belousov et al. |
| 2005/0205696 | A1 | 9/2005 | Saito et al. |
| 2005/0214480 | A1 | 9/2005 | Garbar et al. |
| 2005/0215689 | A1 | 9/2005 | Garbar et al. |
| 2005/0238804 | A1 | 10/2005 | Garbar et al. |
| 2006/0008590 | A1 | 1/2006 | King et al. |
| 2006/0046461 | A1 | 3/2006 | Benson et al. |
| 2006/0057014 | A1 | 3/2006 | Oda et al. |
| 2006/0163570 | A1 | 7/2006 | Renn et al. |
| 2006/0172073 | A1 | 8/2006 | Groza et al. |
| 2006/0175431 | A1 | 8/2006 | Renn et al. |
| 2006/0233953 | A1 | 10/2006 | Renn et al. |
| 2006/0280866 | A1 | 12/2006 | Marquez et al. |
| 2007/0019028 | A1 | 1/2007 | Renn |
| 2007/0154634 | A1 | 7/2007 | Renn |
| 2007/0181060 | A1 | 8/2007 | Renn et al. |
| 2008/0013299 | A1 | 1/2008 | Renn |
| 2009/0061077 | A1 | 3/2009 | King et al. |
| 2009/0061089 | A1 | 3/2009 | King et al. |
| 2009/0090298 | A1 | 4/2009 | King et al. |
| 2009/0114151 | A1 | 5/2009 | Renn et al. |
| 2011/0129615 | A1 | 6/2011 | Renn et al. |

FOREIGN PATENT DOCUMENTS

| | | | |
|---|---|---|---|
| EP | 0 444 550 | A2 | 9/1991 |
| EP | 0470911 | | 7/1994 |
| EP | 1 258 293 | | 11/2002 |
| JP | 2001-507449 | | 6/2001 |
| JP | 2007-507114 | | 3/2007 |
| KR | 10-2007-0008614 | | 1/2007 |
| KR | 10-2007-0008621 | | 1/2007 |
| WO | WO 00/23825 | | 4/2000 |
| WO | WO 00/69235 | | 11/2000 |
| WO | WO-01/83101 | A1 | 11/2001 |
| WO | WO 2006/041657 | A2 | 4/2006 |
| WO | WO 2006/065978 | A2 | 6/2006 |

OTHER PUBLICATIONS

Ashkin, A , "Acceleration and Trapping of Particles by Radiation Pressure", *Physical Review Letters* Jan. 26, 1970 , 156-159.

Ashkin, A. , "Optical trapping and manipulation of single cells using infrared laser beams", *Nature* Dec. 1987 , 769-771.

Dykhuizen, R. C. , "Impact of High Velocity Cold Spray Particles", May 13, 2000 , 1-18.

Fernandez De La Mora, J. et al., "Aerodynamic focusing of particles in a carrier gas", *J. Fluid Mech.* vol. 195, printed in Great Britain 1988, 1-21.

King, Bruce et al., "M3D TM Technology: Maskless Mesoscale TM Materials Deposition", *Optomec pamphlet* 2001.

Lewandowski, H. J. et al., "Laser Guiding of Microscopic Particles in Hollow Optical Fibers", *Announcer 27, Summer Meeting—Invited and Contributed Abstracts* Jul. 1997 , 89.

Marple, V. A. et al., "Inertial, Gravitational, Centrifugal, and Thermal Collection Techniques", *Aerosol Measurement: Principles, Techniques and Applications* 2001 , 229-260.

Miller, Doyle et al., "Maskless Mesoscale Materials Deposition", *HDI* vol. 4,.No. 9 Sep. 2001 , 1-3.

Odde, D. J. et al., "Laser-Based Guidance of Cells Through Hollow Optical Fibers", *The American Society for Cell Biology Thirty-Seventh Annual Meeting* Dec. 17, 1997.

Odde, D. J. et al., "Laser-guided direct writing for applications in biotechnology", *Trends in Biotechnology* Oct. 1999 , 385-389.

Rao, N. P. et al., "Aerodynamic Focusing of Particles in Viscous Jets", *J. Aerosol Sci.* vol. 24, No. 7, Pergamon Press, Ltd., Great Britain 1993 , 879-892.

Renn, M. J. et al., "Evanescent-wave guiding of atoms in hollow optical fibers", *Physical Review A* Feb. 1996 , R648-R651.

Renn, Michael J. et al., "Flow- and Laser-Guided Direct Write of Electronic and Biological Components", *Direct-Write Technologies for Rapid Prototyping Applications* Academic Press 2002 , 475-492.

Renn, M. J. et al., "Laser-Guidance and Trapping of Mesoscale Particles in Hollow-Core Optical Fibers", *Physical Review Letters* Feb. 15, 1999 , 1574-1577.

Renn, M. J. et al., "Laser-Guided Atoms in Hollow-Core Optical Fibers", *Physical Review Letters* Oct. 30, 1995 , 3253-3256.

Renn, M. J. et al., "Optical-dipole-force fiber guiding and heating of atoms", *Physical Review A* May 1997 , 3684-3696.

Renn, M. J. et al., "Particle Manipulation and Surface Patterning by Laser Guidance", *Submitted to EIPBN '98, Session AM4* 1998.

Renn, M. J. et al., "Particle manipulation and surface patterning by laser guidance", *Journal of Vacuum Science & Technology B* Nov./Dec. 1998 , 3859-3863.

Sobeck, et al., *Technical Digest: 1994 Solid-State Sensor and Actuator Workshop* 1994 , 647.

TSI Incorporated, "How a Virtual Impactor Works", www.tsi.com Sep. 21, 2001.

Vanheusden, K. et al., "Direct Printing of Interconnect Materials for Organic Electronics", *IMAPS ATW, Printing an Intelligent Future* Mar. 8-10, 2002 , 1-5.

Zhang, Xuefeng et al., "A Numerical Characterization of Particle Beam Collimation by an Aerodynamic Lens-Nozzle System: Part I. An Individual Lens or Nozzle", *Aerosol Science and Technology* vol. 36, Taylor and Francis 2002 , 617-631.

* cited by examiner

MINIATURE AEROSOL JET AND AEROSOL JET ARRAY

CROSS-REFERENCE TO RELATED APPLICATIONS

This application is a continuation of U.S. patent application Ser. No. 11/302,091, entitled "Miniature Aerosol Jet and Aerosol Jet Array", filed on Dec. 12, 2005, which claims the benefit of the filing of U.S. Provisional Patent Application Ser. No. 60/635,847, entitled "Miniature Aerosol Jet and Aerosol Jet Array," filed on Dec. 13, 2004, and U.S. Provisional Patent Application Ser. No. 60/669,748, entitled "Atomizer Chamber and Aerosol Jet Array," filed on Apr. 8, 2005, and the specifications and claims thereof are incorporated herein by reference.

BACKGROUND OF THE INVENTION

Field of the Invention (Technical Field)

The present invention relates to direct printing of various aerosolized materials using a miniaturized aerosol jet, or an array of miniaturized aerosol jets. The invention more generally relates to maskless, non-contact printing onto planar or non-planar surfaces. The invention may also be used to print materials onto heat-sensitive targets, is performed under atmospheric conditions, and is capable of deposition of micron-size features.

SUMMARY OF THE INVENTION

The present invention is a deposition head assembly for depositing a material on a target, the deposition head assembly comprising a deposition head comprising a channel for transporting an aerosol comprising the material, one or more inlets for introducing a sheath gas into the deposition head; a first chamber connected to the inlets; a region proximate to an exit of the channel for combining the aerosol with the sheath gas, thereby forming an annular jet comprising an outer sheath flow surrounding an inner aerosol flow; and an extended nozzle. The deposition head assembly preferably has a diameter of less than approximately 1 cm. The inlets are preferably circumferentially arranged around the channel. The region optionally comprises a second chamber.

The first chamber is optionally external to the deposition head and develops a cylindrically symmetric distribution of sheath gas pressure about the channel before the sheath gas is combined with the aerosol. The first chamber is preferably sufficiently long enough to develop a cylindrically symmetric distribution of sheath gas pressure about the channel before the sheath gas is combined with the aerosol. The deposition head assembly optionally further comprises a third chamber for receiving sheath gas from the first chamber, the third chamber assisting the first chamber in developing a cylindrically symmetric distribution of sheath gas pressure about the channel before the sheath gas is combined with the aerosol. The third chamber is preferably connected to the first chamber by a plurality of passages which are parallel to and circumferentially arranged around the channel. The deposition head assembly preferably comprises one or more actuators for translating or tilting the deposition head relative to the target.

The invention is also an apparatus for depositing a material on a target, the apparatus comprising a plurality of channels for transporting an aerosol comprising the material, a sheath gas chamber surrounding the channels, a region proximate to an exit of each of the channels for combining the aerosol with sheath gas, thereby forming an annular jet for each channel, the jet comprising an outer sheath flow surrounding an inner aerosol flow, and an extended nozzle corresponding to each of the channels. The plurality of channels preferably form an array. The aerosol optionally enters each of the channels from a common chamber. The aerosol is preferably individually fed to at least one of the channels. A second aerosolized material is optionally fed to at least one of the channels. The aerosol mass flow rate in at least one of the channels is preferably individually controllable. The apparatus preferably comprises one or more actuators for translating or tilting one or more of the channels and extended nozzles relative to the target.

The apparatus preferably further comprises an atomizer comprising a cylindrical chamber for holding the material, a thin polymer film disposed on the bottom of the chamber, an ultrasonic bath for receiving the chamber and directing ultrasonic energy up through the film, a carrier tube for introducing carrier gas into the chamber, and one or more pickup tubes for delivering the aerosol to the plurality of channels. The carrier tube preferably comprises one or more openings. The apparatus preferably further comprises a funnel attached to the tube for recycling large droplets of the material. Additional material is optionally continuously provided to the atomizer to replace material which is delivered to the plurality of channels.

An object of the present invention is to provide a miniature deposition head for depositing materials on a target.

An advantage of the present invention is that miniaturized deposition heads are easily incorporated into compact arrays, which allow multiple depositions to be performed in parallel, thus greatly reducing deposition time.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

A BRIEF DESCRIPTION OF THE DRAWINGS

Figure 1B:
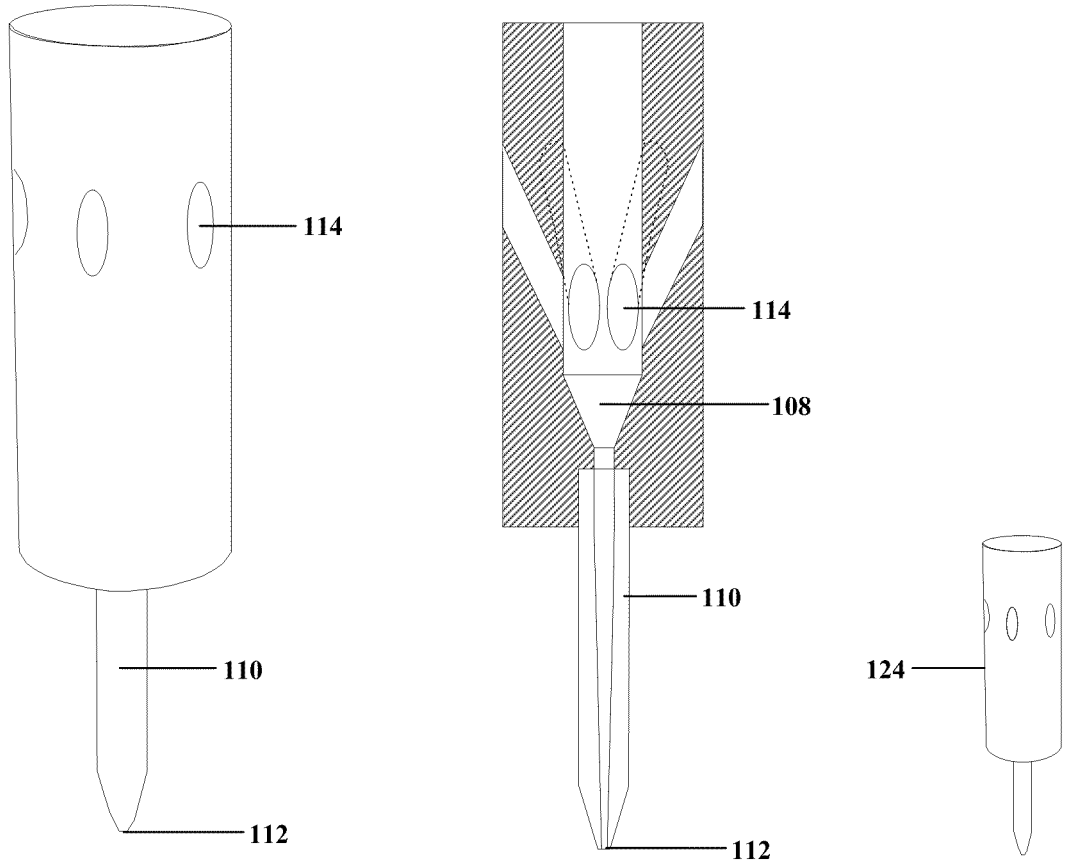
Figure 1C:
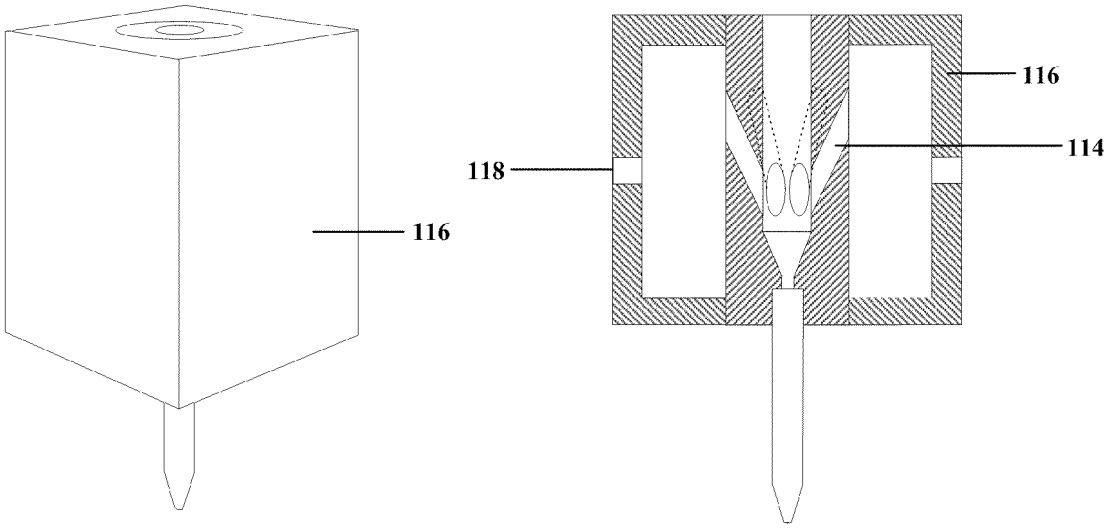
Figure 1D:
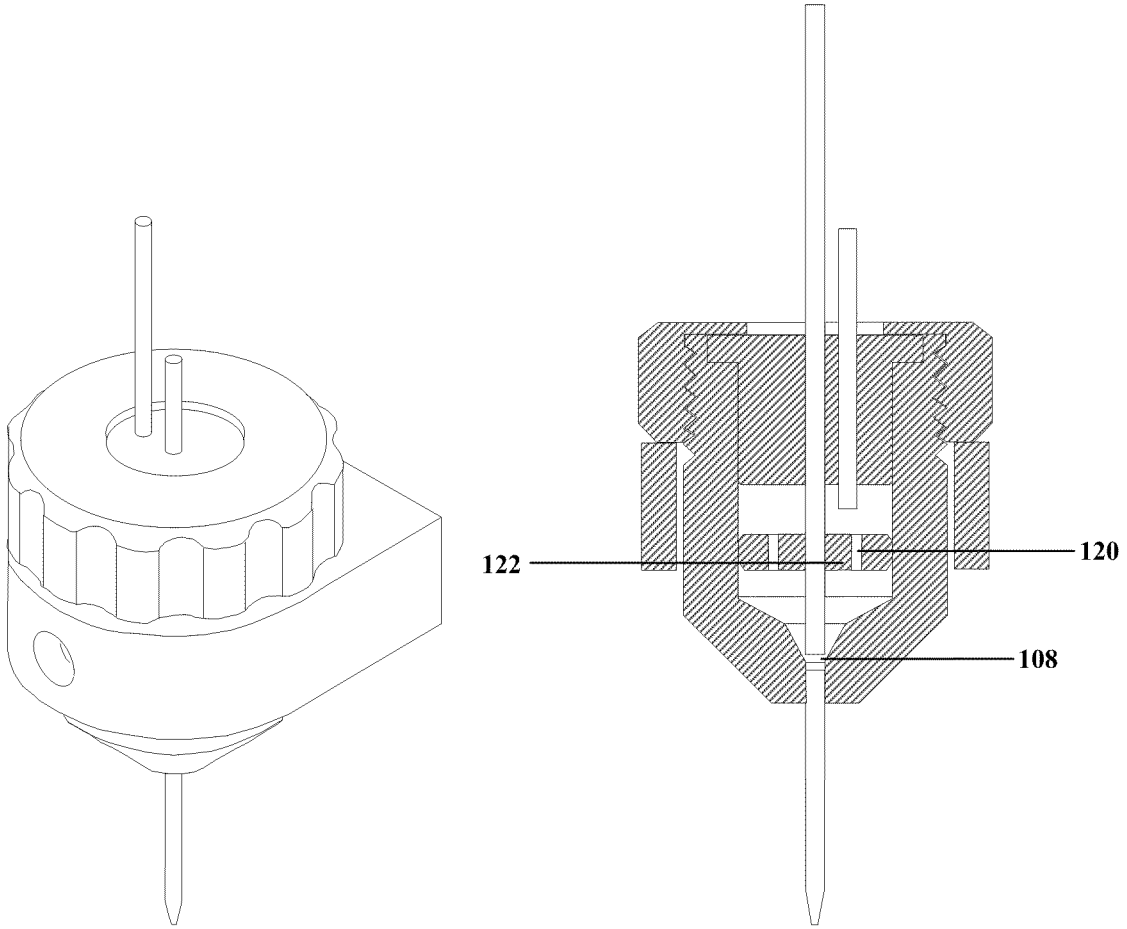
Figure 1E:
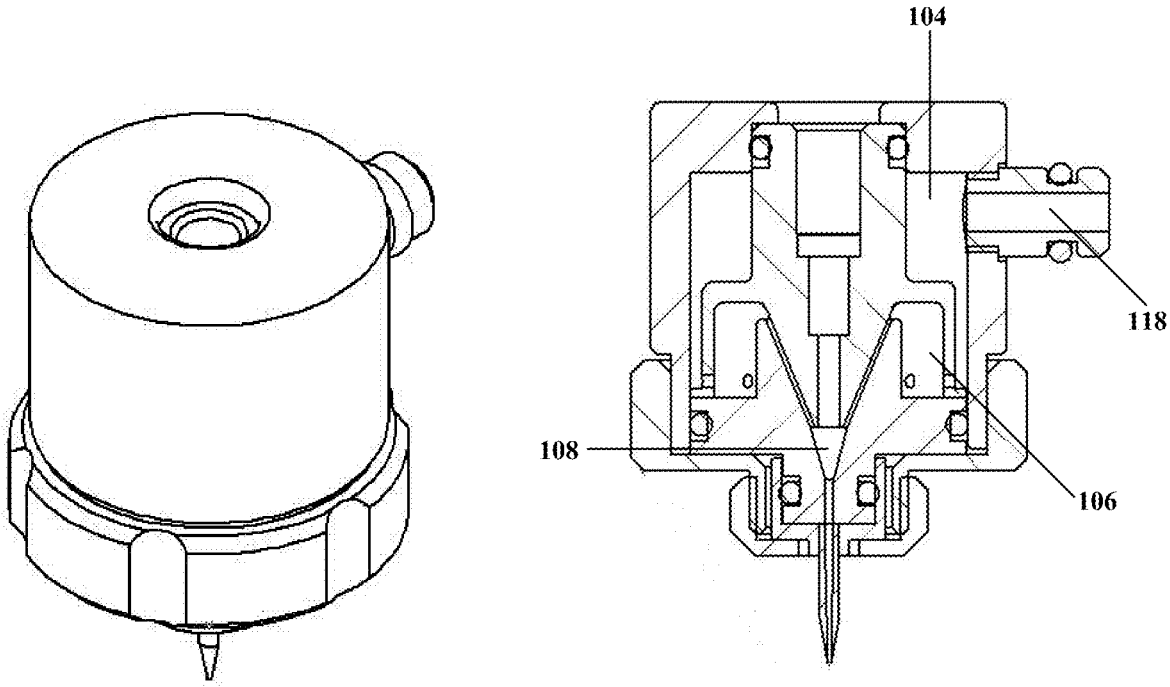
Figure 1F:
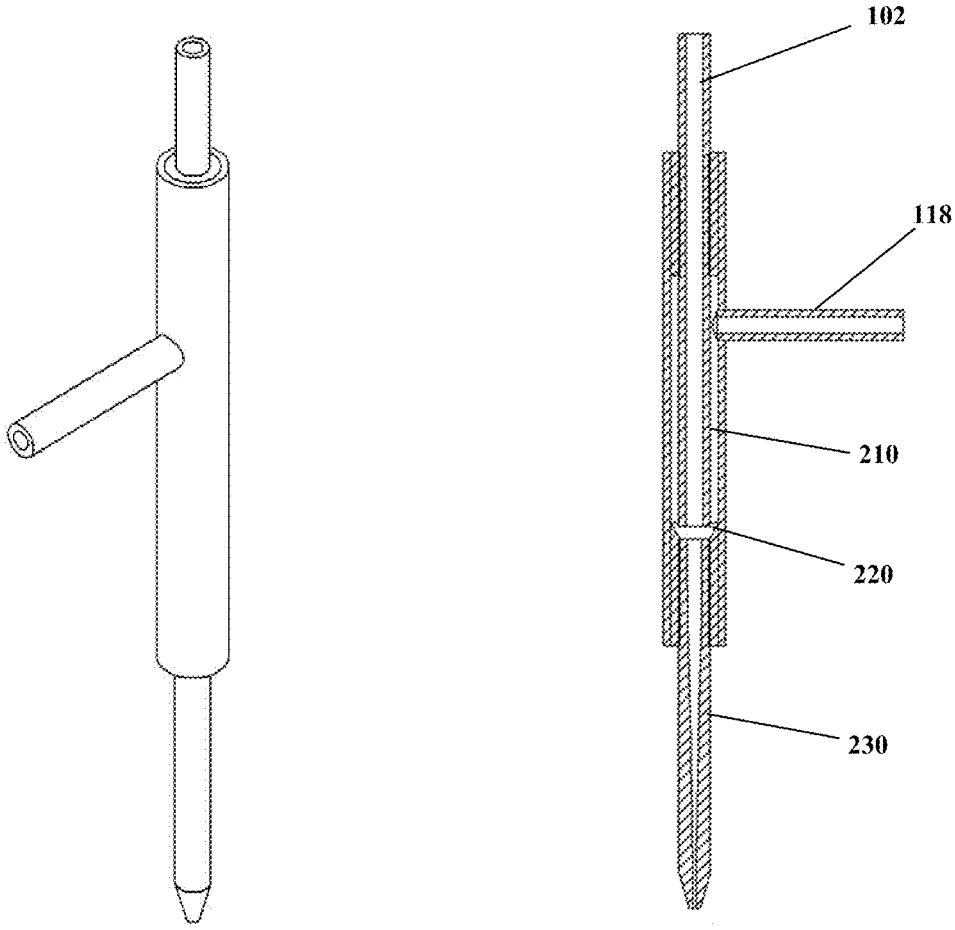
Figure 2:
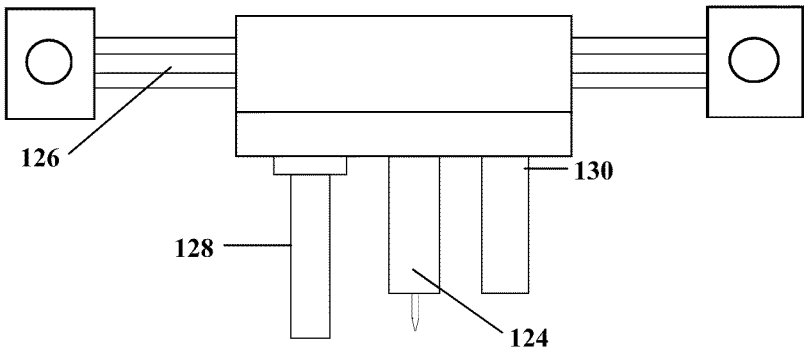
Figure 3:
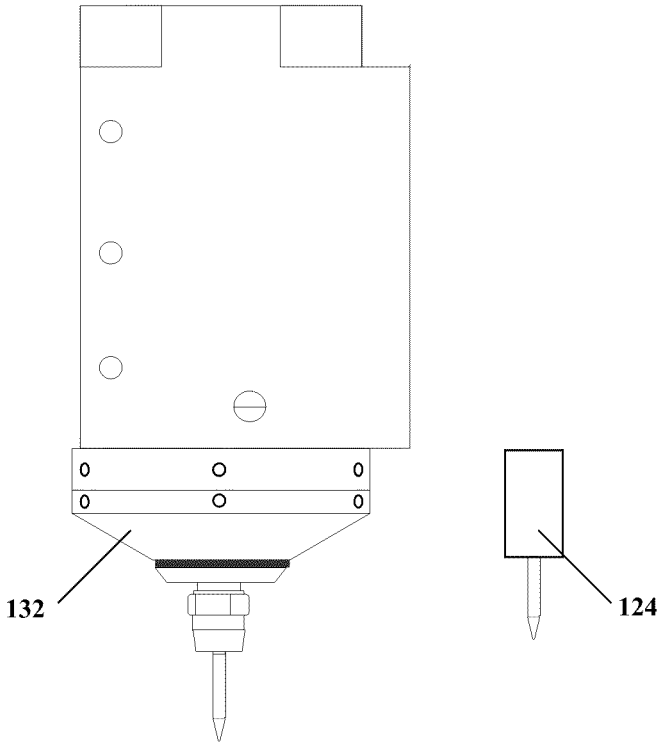
Figure 4A:
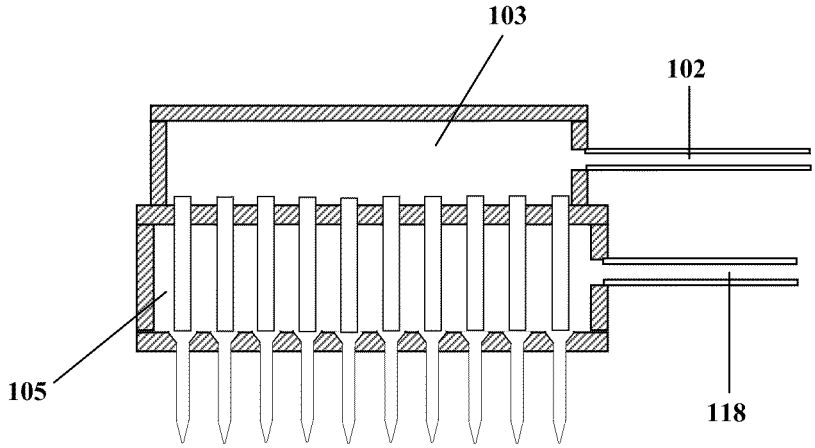
Figure 4B:
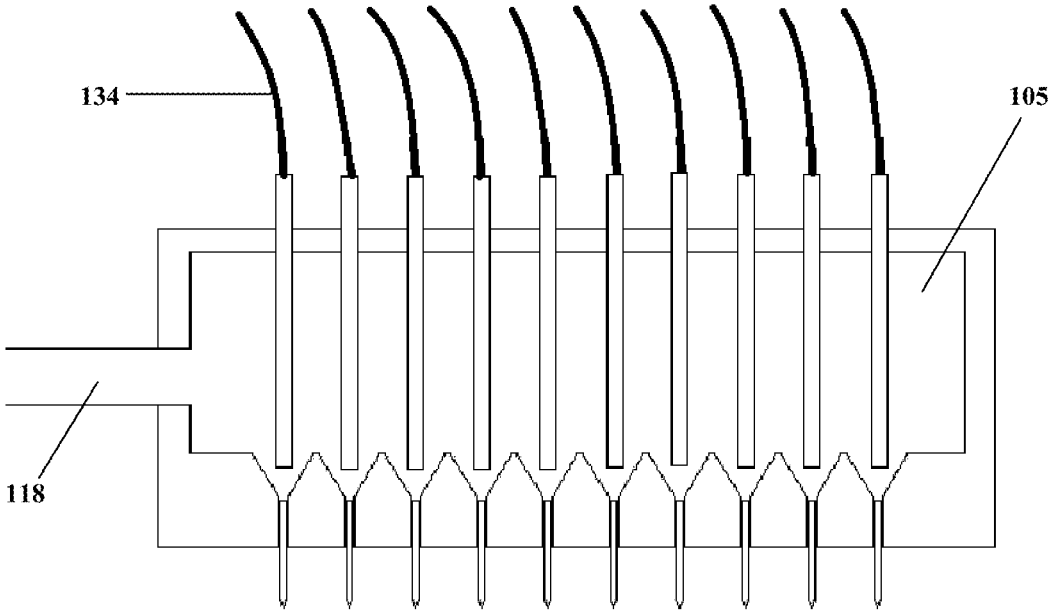
Figure 5A:
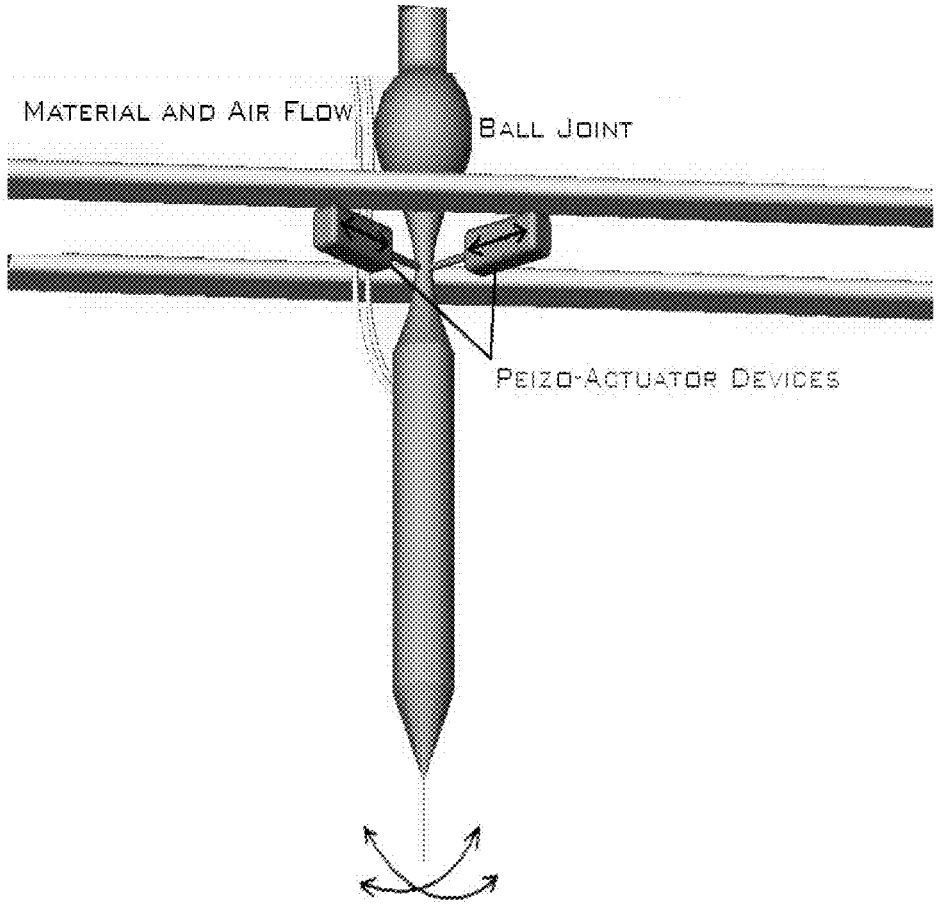
Figure 5B:
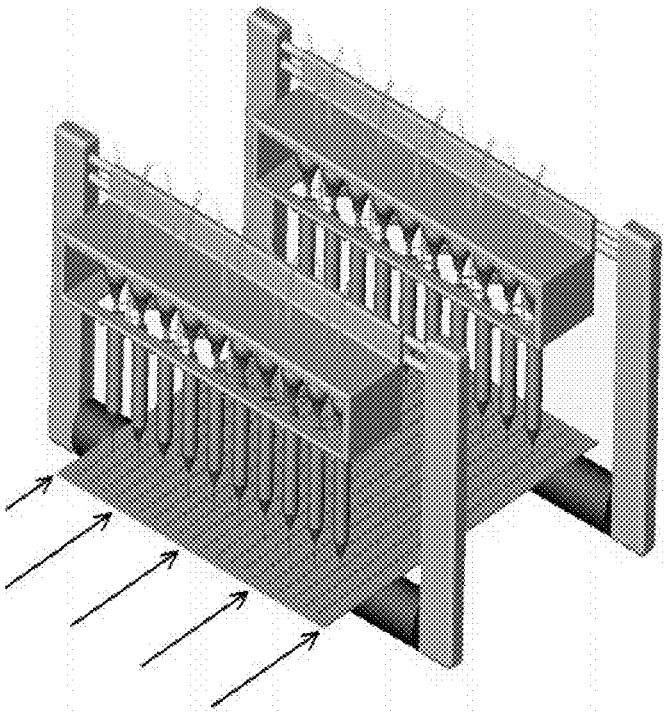

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 1*a* is a cross-section of a miniature deposition head of the present invention;

FIG. 1*b* displays isometric and cross-sectional views of an alternate miniature deposition head that introduces the sheath gas from six equally spaced channels;

FIG. 1*c* shows isometric and cross-sectional views of the deposition head of FIG. 1*b* with an accompanying external sheath plenum chamber;

FIG. 1*d* shows isometric and a cross-sectional views of a deposition head configuration that introduces the aerosol and sheath gases from tubing that runs along the axis of the head;

FIG. 1*e* shows isometric and a cross-sectional views of a deposition head configuration that uses internal plenum chambers and introduces the sheath air through a port that connects the head to a mounting assembly;

FIG. 1*f* shows isometric and cross-sectional views of a deposition head that uses no plenum chambers, providing for the largest degree of miniaturization;

FIG. 2 is a schematic of a single miniaturized deposition head mounted on a movable gantry;

FIG. 3 compares a miniature deposition head to a standard $M^3D$® deposition head;

FIG. 4*a* is a schematic of the multiplexed head design;

FIG. 4*b* is a schematic of the multiplexed head design with individually fed nozzles;

FIG. 5*a* shows the miniature aerosol jet in a configuration that allows the head to be tilted about two orthogonal axes;

FIG. 5*b* shows an array of piezo-driven miniature aerosol jets; and

Figure 6:
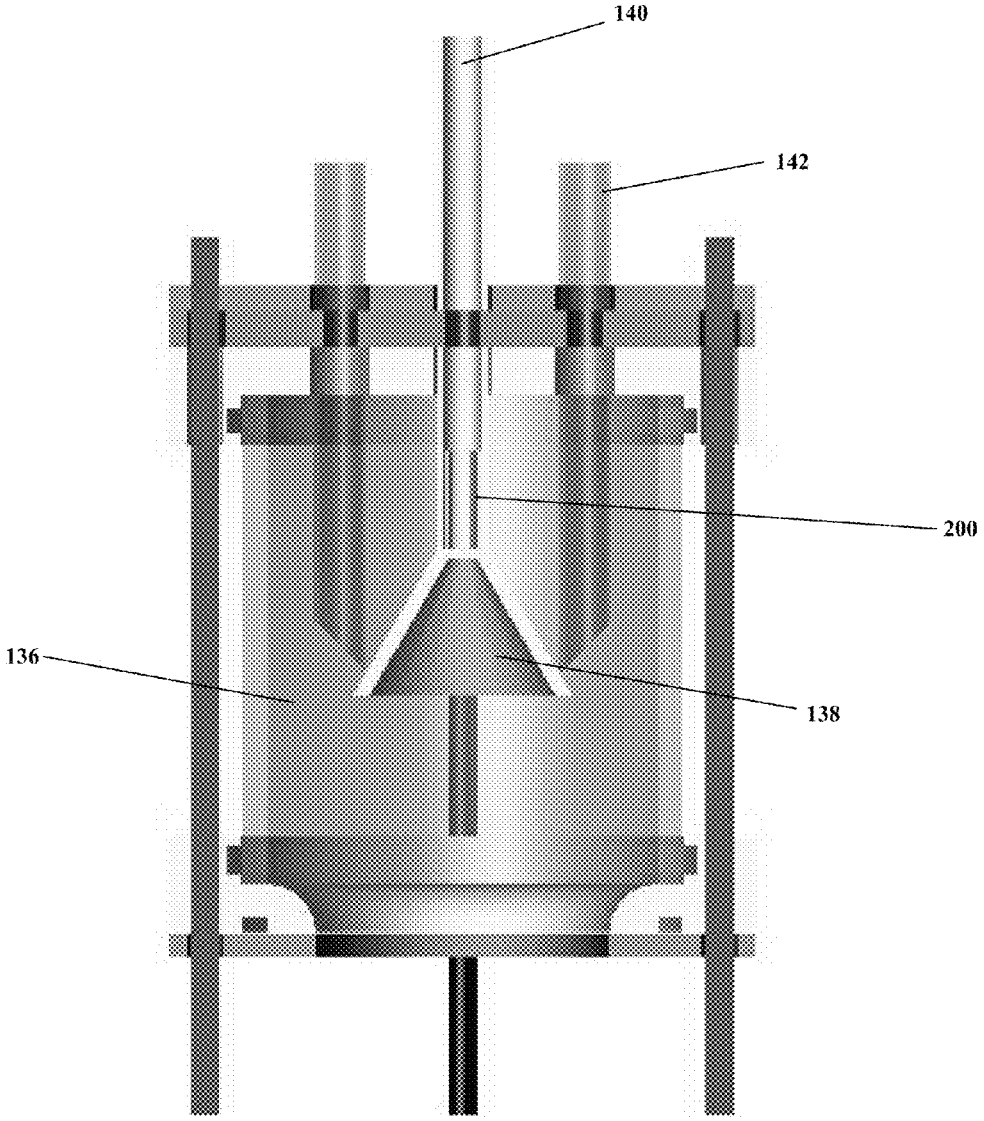

FIG. 6 shows perspective and cutaway views of the atomizer assembly used with miniature aerosol jet arrays.

DESCRIPTION OF THE PREFERRED EMBODIMENTS

Best Modes for Carrying out the Invention

Introduction

The present invention generally relates to apparatuses and methods for high-resolution, maskless deposition of liquid and liquid-particle suspensions using aerodynamic focusing. In the most commonly used embodiment, an aerosol stream is focused and deposited onto a planar or non-planar target, forming a pattern that is thermally or photochemically processed to achieve physical, optical, and/or electrical properties near that of the corresponding bulk material. The process is called $M^3D$®, Maskless Mesoscale Material Deposition, and is used to deposit aerosolized materials with linewidths that are an order of magnitude smaller than lines deposited with conventional thick film processes. Deposition is performed without the use of masks. The term mesoscale refers to sizes from approximately 1 micron to 1 millimeter, and covers the range between geometries deposited with conventional thin film and thick film processes. Furthermore, with post-processing laser treatment, the $M^3D$® process is capable of defining lines having widths as small as 1 micron.

The $M^3D$® apparatus preferably uses an aerosol jet deposition head to form an annularly propagating jet composed of an outer sheath flow and an inner aerosol-laden carrier flow. In the annular aerosol jetting process, the aerosol stream enters the deposition head, preferably either directly after the aerosolization process or after passing through the heater assembly, and is directed along the axis of the device towards the deposition head orifice. The mass throughput is preferably controlled by an aerosol carrier gas mass flow controller. Inside the deposition head, the aerosol stream is preferably initially collimated by passing through a millimeter-size orifice. The emergent particle stream is then preferably combined with an annular sheath gas. The carrier gas and the sheath gas most commonly comprise compressed air or an inert gas, where one or both may contain a modified solvent vapor content. For example, when the aerosol is formed from an aqueous solution, water vapor may be added to the carrier gas or the sheath gas to prevent droplet evaporation.

The sheath gas preferably enters through a sheath air inlet below the aerosol inlet and forms an annular flow with the aerosol stream. As with the aerosol carrier gas, the sheath gas flowrate is preferably controlled by a mass flow controller. The combined streams exit the extended nozzle through an orifice directed at a target. This annular flow focuses the aerosol stream onto the target and allows for deposition of features with dimensions as small as approximately 5 microns.

In the $M^3D$® method, once the sheath gas is combined with the aerosol stream, the flow does not need to pass through more than one orifice in order to deposit sub-millimeter linewidths. In the deposition of a 10-micron line, the $M^3D$® method typically achieves a flow diameter constriction of approximately 250, and may be capable of constrictions in excess of 1000, for this "single-stage" deposition. No axial constrictors are used, and the flows typically do not reach supersonic flow velocities, thus preventing the formation of turbulent flow, which could potentially lead to a complete constriction of the flow.

Enhanced deposition characteristics are obtained by attaching an extended nozzle to the deposition head. The nozzle is attached to the lower chamber of the deposition head preferably using pneumatic fittings and a tightening nut, and is preferably approximately 0.95 to 1.9 centimeters long. The nozzle reduces the diameter of the emergent stream and collimates the stream to a fraction of the nozzle orifice diameter at distances of approximately 3 to 5 millimeters beyond the nozzle exit. The size of the orifice diameter of the nozzle is chosen in accordance with the range of desired linewidths of the deposited material. The exit orifice may have a diameter ranging from approximately 50 to 500 microns. The deposited linewidth can be approximately as small as one-twentieth the size of the orifice diameter, or as large as the orifice diameter. The use of a detachable extended nozzle also enables the size of deposited structures to be varied from as small as a few microns to as large as a fraction of a millimeter, using the same deposition apparatus. The diameter of the emerging stream (and therefore the linewidth of the deposit) is controlled by the exit orifice size, the ratio of sheath gas flow rate to carrier gas flow rate, and the distance between the orifice and the target. Enhanced deposition can also be obtained using an extended nozzle that is machined into the body of the deposition head. A more detailed description of such an extended nozzle is contained in commonly-owned U.S. patent application Ser. No. 11/011,366, entitled "Annular Aerosol Jet Deposition Using An Extended Nozzle", filed on Dec. 13, 2004, which is incorporated in its entirety herein by reference.

In many applications, it is advantageous to perform deposition from multiple deposition heads. The use of multiple deposition heads for direct printing applications may be facilitated by using miniaturized deposition heads to increase the number of nozzles per unit area. The miniature deposition head preferably comprises the same basic internal geometry as the standard head, in that an annular flow is formed between the aerosol and sheath gases in a configuration similar to that of the standard deposition head. Miniaturization of the deposition head also facilitates a direct write process in which the deposition head is mounted on a moving gantry, and deposits material on a stationary target.

Miniature Aerosol Jet Deposition Head and Jet Arrays

Miniaturization of the $M^3D$® deposition head may reduce the weight of the device by more than an order of magnitude, thus facilitating mounting and translation on a movable gantry. Miniaturization also facilitates the fabrication and operation of arrayed deposition heads, enabling construction and operation of arrays of aerosol jets capable of independent motion and deposition. Arrayed aerosol jets provide an increased deposition rate, arrayed deposition, and multi-material deposition. Arrayed aerosol jets also provide for increased nozzle density for high-resolution direct write applications, and can be manufactured with customized jet spacing and configurations for specific deposition applications. Nozzle configurations include, but are not limited to, linear, rectangular, circular, polygonal, and various nonlinear arrangements.

The miniature deposition head functions similarly, if not identically, to the standard deposition head, but has a diameter that is approximately one-fifth the diameter of the larger unit. Thus the diameter or width of the miniature deposition head is preferably approximately 1 cm, but could be smaller or larger. The several embodiments detailed in this application disclose various methods of introducing and distributing the sheath gas within the deposition head, as well as methods of combining the sheath gas flow with the aerosol flow. Development of the sheath gas flow within the deposition head is critical to the deposition characteristics of the system, determines the final width of the jetted aerosol stream and the amount and the distribution of satellite droplets deposited beyond the boundaries of the primary deposit, and minimizes clogging of the exit orifice by forming a barrier between the wall of the orifice and the aerosol-laden carrier gas.

A cross-section of a miniature deposition head is shown in FIG. 1*a*. An aerosol-laden carrier gas enters the deposition head through aerosol port 102, and is directed along the axis of the device. An inert sheath gas enters the deposition head laterally through ports connected to upper plenum chamber 104. The plenum chamber creates a cylindrically symmetric distribution of sheath gas pressure about the axis of the deposition head. The sheath gas flows to conical lower plenum chamber 106, and is combined with the aerosol stream in a combination chamber 108, forming an annular flow consisting of an inner aerosol-laden carrier gas flow and an outer inert sheath gas flow. The annular flow is propagated through an extended nozzle 110, and exits at the nozzle orifice 112.

FIG. 1*b* shows an alternate embodiment in which the sheath gas is introduced from six equally spaced channels. This configuration does not incorporate the internal plenum chambers of the deposition head pictured in FIG. 1*a*. Sheath gas channels 114 are preferably equally spaced about the axis of the device. The design allows for a reduction in the size of the deposition head 124, and easier fabrication of the device. The sheath gas combines with the aerosol carrier gas in combination chamber 108 of the deposition head. As with the previous design, the combined flow then enters an extended nozzle 110 and exits from the nozzle orifice 112. Since this deposition head comprises no plenum chambers, a cylindrically symmetric distribution of sheath gas pressure is preferably established before the sheath gas is injected into the deposition head. FIG. 1*c* shows a configuration for developing the required sheath gas pressure distribution using external plenum chamber 116.

In this configuration, the sheath gas enters the plenum chamber from ports 118 located on the side of the chamber, and flows upward to the sheath gas channels 114.

FIG. 1*d* shows isometric and cross-sectional views of a deposition head configuration that introduces the aerosol and sheath gases from tubing that runs along the axis of the head. In this configuration, a cylindrically symmetric pressure distribution is obtained by passing the sheath gas through preferably equally spaced holes 120 in disk 122 centered on the axis of the head. The sheath gas is then combined with the aerosol carrier gas in a combination chamber 108.

FIG. 1*e* shows isometric and cross-sectional views of a deposition head configuration of the present invention that uses internal plenum chambers, and introduces the sheath air through a port 118 that preferably connects the head to a mounting assembly. As in the configuration of FIG. 1*a*, the sheath gas enters an upper plenum chamber 104 and then flows to a lower plenum chamber 106 before flowing to a combination chamber 108. However in this case, the distance between the upper and lower plenum chambers is reduced to enable further miniaturization of the deposition head.

FIG. 1*f* shows isometric and cross-sectional views of a deposition head that uses no plenum chambers, providing for the largest degree of miniaturization. The aerosol enters sheath gas chamber 210 through an opening in the top of aerosol tube 102. The sheath gas enters the head through input port 118, which is optionally oriented perpendicularly to aerosol tube 102, and combines with the aerosol flow at the bottom of aerosol tube 102. Aerosol tube 102 may extend partially or fully to the bottom of sheath gas chamber 210. The length of sheath gas chamber 210 should be sufficiently long to ensure that the flow of the sheath gas is substantially parallel to the aerosol flow before the two combine, thereby generating a preferably cylindrically symmetric sheath gas pressure distribution. The sheath gas is then combined with the aerosol carrier gas at or near the bottom of sheath gas chamber 210 and the combined gas flows are directed into extended nozzle 230 by converging nozzle 220.

FIG. 2 shows a schematic of a single miniaturized deposition head 124 mounted on a movable gantry 126. The system preferably includes an alignment camera 128 and a processing laser 130. The processing laser can be a fiber-based laser. In this configuration, recognition and alignment, deposition, and laser processing are performed in a serial fashion. The configuration significantly reduces the weight of the deposition and processing modules of the $M^3D$® system, and provides an inexpensive solution to the problem of maskless, non-contact printing of mesoscale structures.

FIG. 3 displays standard $M^3D$® deposition head 132 side by side with miniature deposition head 124. Miniature deposition head 124 is approximately one-fifth the diameter of standard deposition head 132.

Miniaturization of the deposition head enables fabrication of a multiplexed head design. A schematic of such a device is shown in FIG. 4*a*. In this configuration, the device is monolithic, and the aerosol flow enters aerosol plenum chamber 103 through aerosol gas port 102 and then enters an array of ten heads, although any number of heads may be used. The sheath gas flow enters sheath plenum chamber 105 through at least one sheath gas port 118. In this monolithic configuration, the heads deposit one material simultaneously, in an arrayed fashion. The monolithic configuration can be mounted on a two-axis gantry with a stationary target, or the system can be mounted on a single axis gantry, with a target fed in a direction orthogonal to the motion of the gantry.

FIG. 4*b* shows a second configuration for a multiplexed head. The figure shows ten linearly-arrayed nozzles (although any number of nozzles may be arrayed in any one or two dimensional pattern), each being fed by individual aerosol port 134. The configuration allows for uniform mass flow between each nozzle. Given a spatially uniform atomization source, the amount of aerosol delivered to each nozzle is dependent on the mass flowrate of the flow controller or flow controllers, and is independent of the position of the nozzle in the array. The configuration of FIG. 4*b* also allows for deposition of more than one material from a single deposition head. These different materials may optionally be deposited simultaneously or sequentially in any desired pattern or sequence. In such an application, a different material may be delivered to each nozzle, with each material being atomized and delivered by the same atomization unit and controller, or by individual atomization units and controllers.

FIG. 5*a* shows a miniature aerosol jet in a configuration that allows the head to be tilted about two orthogonal axes.

FIG. 5*b* is a representation of an array of piezo-driven miniature aerosol jets. The array is capable of translational motion along one axis. The aerosol jets are preferably attached to a bracket by flexure mountings. The heads are tilted by applying a lateral force using a piezoelectric actuator, or alternatively by actuating one or more (preferably two) galvanometers. The aerosol plenum can be replaced with a bundle of tubes each feeding an individual depositing head. In this configuration, the aerosol jets are capable of independent deposition.

Atomizer Chamber for Aerosol Jet Array

An aerosol jet array requires an atomizer that is significantly different from the atomizer used in a standard $M^3D$® system. FIG. 6 shows a cutaway view of an atomizer that has a capacity sufficient to feed aerosolized mist to ten or more arrayed or non-arrayed nozzles. The atomizer assembly comprises an atomizer chamber 136, preferably a glass cylinder, on the bottom of which is preferably disposed a thin polymer film which preferably comprises Kapton®. The atomizer assembly is preferably set inside an ultrasonic atomizer bath with the ultrasonic energy directed up through the film. This film transmits the ultrasonic energy to the functional ink, which is then atomized to generate an aerosol.

Containment funnel 138 is preferably centered within atomizer chamber 136 and is connected to carrier gas port 140, which preferably comprises a hollow tube that extends out of the top of the atomizer chamber 136. Port 140 preferably comprises one or more slots or notches 200 located just above funnel 138, which allow the carrier gas to enter chamber 136. Funnel 138 contains the large droplets that are formed during atomization and allows them to downward along the tube to the bath to be recycled. Smaller droplets are entrained in the carrier gas, and delivered as an aerosol or mist from the atomizer assembly via one or more pickup tubes 142 which are preferably mounted around funnel 138.

The number of aerosol outputs for the atomizer assembly is preferably variable and depends on the size of the multinozzle array. Gasket material is preferably positioned on the top of the atomizer chamber 136 as a seal and is preferably sandwiched between two pieces of metal. The gasket material creates a seal around pickup tubes 142 and carrier gas port 140. Although a desired quantity of material to be atomized may be placed in the atomization assembly for batch operation, the material may be continuously fed into the atomizer assembly, preferably by a device such as a syringe pump, through one or more material inlets which are preferably disposed through one or more holes in the gasket material. The feed rate is preferably the same as the rate at which material is being removed from the atomizer assembly, thus maintaining a constant volume of ink or other material in the atomization chamber.

Shuttering and Aerosol Output Balancing

Shuttering of the miniature jet or miniature jet arrays can be accomplished by using a pinch valve positioned on the aerosol gas input tubing. When actuated, the pinch valve constricts the tubing, and stops the flow of aerosol to the deposition head. When the valve is opened, the aerosol flow to the head is resumed. The pinch valve shuttering scheme allows the nozzle to be lowered into recessed features and enables deposition into such features, while maintaining a shuttering capability.

In addition, in the operation of a multinozzle array, balancing of the aerosol output from individual nozzles may be necessary. Aerosol output balancing may be accomplished by constricting the aerosol input tubes leading to the individual nozzles, so that corrections to the relative aerosol output of the nozzles can be made, resulting in a uniform mass flux from each nozzle.

Applications involving a miniature aerosol jet or aerosol jet array include, but are not limited to, large area printing, arrayed deposition, multi-material deposition, and conformal printing onto 3-dimensional objects using 4/5 axis motion.

Although the present invention has been described in detail with reference to particular preferred and alternative embodiments, persons possessing ordinary skill in the art to which this invention pertains will appreciate that various modifications and enhancements may be made without departing from the spirit and scope of the Claims that follow, and that other embodiments can achieve the same results. The various configurations that have been disclosed above are intended to educate the reader about preferred and alternative embodiments, and are not intended to constrain the limits of the invention or the scope of the Claims. Variations and modifications of the present invention will be obvious to those skilled in the art, and it is intended to cover all such modifications and equivalents. The entire disclosures of all patents and publications cited above are hereby incorporated by reference.

What is claimed is:

1. A deposition head for depositing a material on a target, the deposition head comprising:

a tube for transporting an aerosol comprising the material;

a chamber for transporting a sheath gas, said chamber surrounding at least a portion of said tube;

a converging nozzle for combining the sheath gas and the aerosol, the aerosol and sheath gas passing through said converging nozzle, thereby forming an annular jet, said annular jet comprising an outer sheath flow surrounding an inner aerosol flow; and an extended nozzle for transporting said annular jet, said extended nozzle comprising an exit opening for said annular jet to exit said extended nozzle.

2. The deposition head of claim 1 wherein said chamber is sufficiently long so that a flow direction of sheath gas is substantially parallel to a flow direction of said aerosol before the sheath gas and the aerosol are combined.

3. The deposition head of claim 2 wherein said chamber is cylindrical.

4. The deposition head of claim 3 wherein a distribution of sheath gas pressure about said tube is cylindrically symmetric.

5. The deposition head of claim 3 wherein said chamber is concentric with said tube.

6. The deposition head of claim 1 wherein said extended nozzle comprises an inner diameter which tapers toward said exit opening.

7. The deposition head of claim 1 wherein said deposition head does not comprise a plenum chamber.

8. A method of depositing a material, the method comprising the steps of:

transporting an aerosol comprising the material through a tube;

transporting a sheath gas through a chamber surrounding the tube;

combining the aerosol and the sheath gas through a converging nozzle to form an annular jet, the annular let comprising an outer sheath flow surrounding an inner aerosol flow;

transporting the annular jet through an extended nozzle, the annular jet exiting the extended nozzle through an opening in the extended nozzle; and depositing the material.

9. The method of claim 8 wherein the step of transporting a sheath gas comprises providing a sufficiently long flow path so that the sheath gas flows substantially parallel to a flow direction of the aerosol before the combining step.

10. The method of claim 8 further comprising the step of forming a cylindrically symmetric distribution of sheath gas pressure about the tube.

11. The method of claim 8 further comprising the step of focusing the annular jet.

* * * * *